United States Patent [19]

Vesborg

[11] 4,418,862

[45] Dec. 6, 1983

[54] HEXAGONAL BOX

[75] Inventor: Steen Vesborg, Copenhagen, Denmark

[73] Assignee: Colgate-Palmolive Company, New York, N.Y.

[21] Appl. No.: 285,130

[22] PCT Filed: Dec. 5, 1980

[86] PCT No.: PCT/DK80/00079

§ 371 Date: Jul. 20, 1981

§ 102(e) Date: Jul. 20, 1981

[87] PCT Pub. No.: WO81/01694

PCT Pub. Date: Jun. 25, 1981

[30] Foreign Application Priority Data

Dec. 7, 1979 [DK] Denmark ..... 5215/79

[51] Int. Cl.[3] ..... B65D 5/08; B65D 5/36

[52] U.S. Cl. ..... 229/41 C; 229/44 R

[58] Field of Search ..... 229/41 C, 41 D, 37 R, 229/44 R

[56] References Cited

U.S. PATENT DOCUMENTS

| | | | |
|---|---|---|---|
| 1,555,054 | 9/1925 | Berkawitz | 229/41 C |
| 1,623,715 | 4/1927 | Berkowitz | 229/41 C |
| 1,892,715 | 1/1933 | Wellman | 229/41 C |
| 2,019,787 | 11/1935 | Leopold | 229/41 C |
| 2,165,906 | 7/1939 | Reich | 229/41 C |
| 3,305,079 | 2/1967 | Bowman | 229/41 C |
| 4,094,457 | 6/1978 | Spillson | 229/41 C |

FOREIGN PATENT DOCUMENTS

| | | | |
|---|---|---|---|
| 2641791 | 3/1978 | Fed. Rep. of Germany | 229/41 C |

*Primary Examiner*—Herbert F. Ross

*Attorney, Agent, or Firm*—Herbert S. Sylvester; Murray M. Grill; John A. Stemwedel

[57] ABSTRACT

A box for instance for storing powder and comprising six side walls. At least three of said side walls are extended to form the top and/or the bottom cover with at least one panel connected with the three side walls. This panel comprises a central main flap and two pairs of side flaps connected thereto through folding rims. These side flaps comprise an oblique triangular rigid portion extending from the main flap and abutting the side walls and furthermore forming an inner obtuse angle therewith, whereas smaller triangular flap(s) in the closed position abut the side walls in question an in case of the bottom cover preferably and are connected to these side walls through folding lines, the main flap being connected to both adjacent side walls. A cut and scored blank is also provided for producing the box. In this manner a tight and simple box is obtained.

6 Claims, 18 Drawing Figures

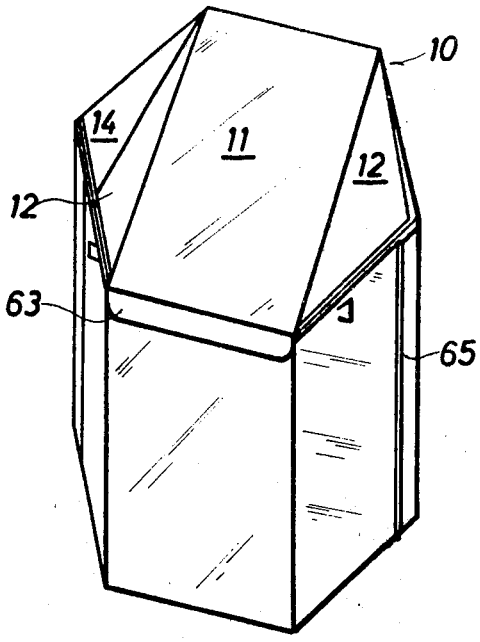
Fig.5
Fig.6
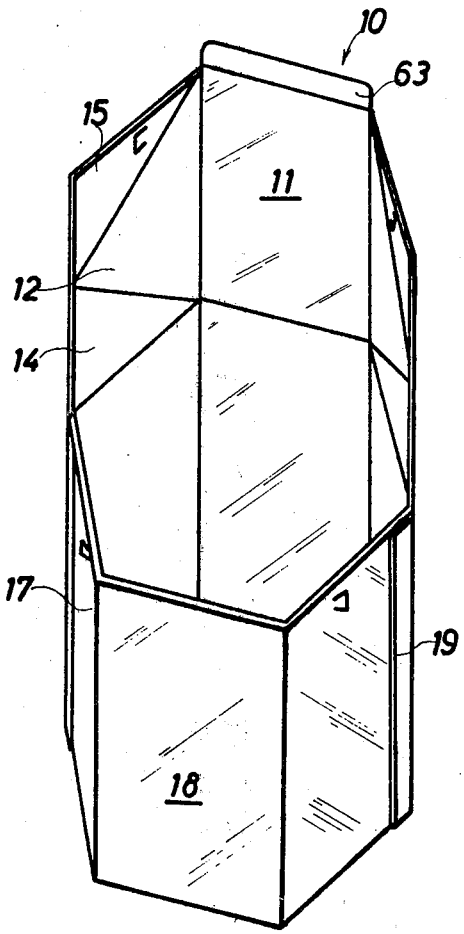

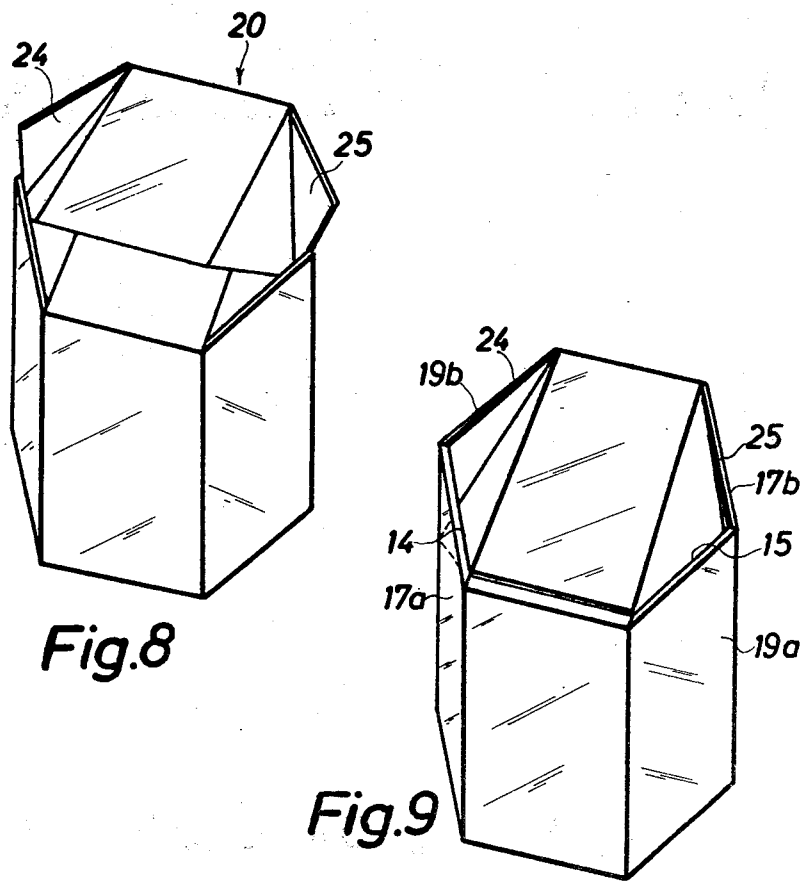
Fig.9
Fig.8
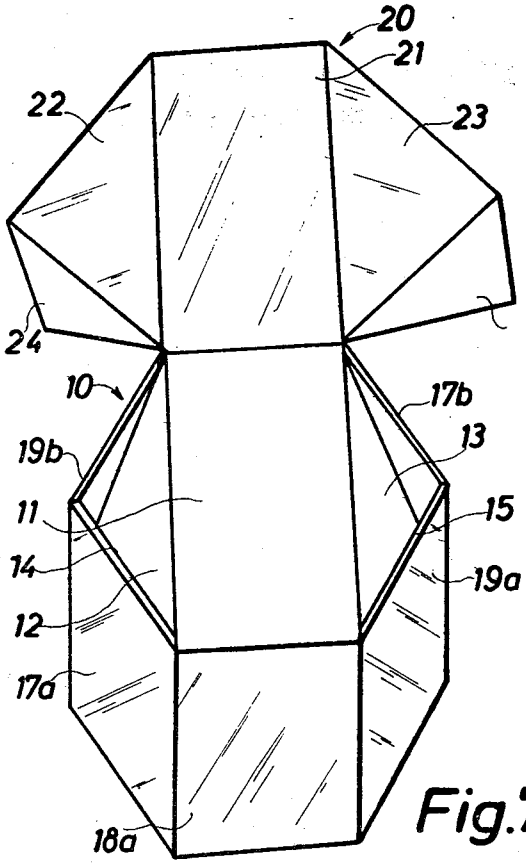
Fig.7

HEXAGONAL BOX

TECHNICAL FIELD

The invention relates to a box for instance for storing powder and comprising six side walls, at least three of said side walls being extended to form a cover, and to a cut and stored blank therefor.

BACKGROUND ART

Hexagonal boxes are known, cf. for instance Danish patent specification No. 127,280 and U.S. Pat. No. 3,174,675. These known boxes are, however, provided with a higher number of panels at the ends, said panels having to be individually folded, whereby the opening and closing of the boxes are complicated. Furthermore, the high number of separated panels implies that leaks between the panels easily occur, which permits penetration of the content such as for instance powder, of the box.

DISCLOSURE OF INVENTION

The object of the invention is to provide a hexagonal box permitting a quick opening and closing, and whereby both the top and the bottom cover comprises a high tightness and rigidity in such a manner that the box may be employed for storing powdered material.

The hexagonal box according to the invention is characterised in that the top and/or the bottom cover comprises at least one panel, which at folding lines is connected with the end rims of three side walls and comprises a central main flap and two pairs of side flaps connected thereto through folding rims, said side flaps comprising two or three triangles connected through folding rims, whereby the main flap forms a central portion, which in the closed position extends to at least four corners and usually is substantially perpendicular to the side walls of the box, each pair of side flaps comprising an oblique triangular rigid portion extending from the main flap and abutting the side walls at a varying distance from the upper hexagonal rim of the box and furthermore forming an inner obtuse angle therewith, whereas the smaller triangular flap(s) in the closed position abut the side walls in question and—in case of the bottom cover—preferably all are connected to these side walls through folding lines, and whereby the main flap is connected to both adjacent side walls through folding lines.

In this manner the box may be closed quickly and simply by means of only one or optionally two panels. The connection between the panels and the side walls as well as the particular shaping of the triangle flaps permit a tight cover and simultaneously provide the box with a certain rigidity, as the oblique triangle flaps projecting inwards are slightly fixed between the main flap and the adjacent side walls. Furthermore, the oblique flaps keep the content away from the end rim of the adjacent side walls, whereby the tightness of the box is improved.

The said cover is particularly suited for forming a bottom, as the box may then be formed in a very simple manner by folding an oblong cut and scored blank comprising a top cover, three side walls located side by side, a rectangular bottom cover, and three additional side walls also located side by side, and optionally an additional top cover. The bottom of the box is produced by situating the side walls perpendicular to the rectangular panel of the bottom, whereafter the side walls are assembled to form a hexagonal cylinder by bending the two largest triangle flaps of the bottom into an oblique position in such a manner that the side walls merely abut each other. At the same time the four smallest triangle flaps thereby abut the adjacent side walls. At the end of the thus situated side walls, the top cover is present, which may subsequently be folded and closed downwards into the hexagonal cylinder.

According to a particularly preferred embodiment of the box according to the invention the cover comprises only one panel with one main flap and six triangular side flaps, two of said side flaps being isosceles and oblique, whereas the four remaining side flaps closely abut the adjacent longitudinal sides. Like the cover, the bottom comprises a main flap and six triangular side flaps shaped in the same manner as the corresponding portions of the cover, and whereby the bottom panel in both ends is connected to the adjacent six side walls along the folded rim (bend). In this manner it is obtained that the box is completely tight and very simple to assemble. Furthermore, the blank for producing the box may be produced in an almost rectangular shape, whereby waste of material is avoided.

According to a particularly simple embodiment of the box according to the invention, the width of the side walls is equal.

According to the invention, the cover of the box may comprise two successively folded panels. The panel finally folded may then be shaped in the same manner as the first panel provided only two of the triangle flaps on the panel finally folded are disengaged from the two side walls. As a result, the two panels cover each other completely and co-operate in ensuring the bottom and the cover, respectively, and in increasing the rigidity of the box. The panel finally folded is then slightly fixed between the side walls and the panel initially folded and thereby ensures that the panel initially folded is unfoldable since the panel initially folded primarily presses on the portion of the panel finally folded being adjacent its hinged folding rim (bend) on the side wall. The above disengaged triangle flaps may be bent upwards in such a manner that the inner sides thereof oppose the inner sides of the adjacent side walls. Such a cover implies that the triangle flaps closely abut the side walls in such a manner that the bottom and the cover, respectively, are closely sealed towards all six side walls, and furthermore in such a manner that a predetermined friction is provided between the triangle flaps and the side walls, thereby providing an improved fixing of the cover.

Moreover according to the invention, the panel finally folded may comprise a main flap and two isosceles triangle flaps connected to the main flap through folding lines, and furthermore two equilateral triangle flaps connected along folding lines with the two isosceles triangle flaps and along folding lines connected to the two adjacent side walls. In this manner all the side walls are hinged to the two panels, whereby an improved tightness is obtained. After the folding of the final panel, all the flaps of this panel are located in almost the same horizontal plane and ensure a good rigidity of the box when this panel is fixed by means of an adhesive wafer or label.

According to a fourth embodiment of the invention, each panel may be an extension of two adjacent side walls and comprise such scored lines that these by folding divide the panel into two or more triangular locking, in fact trapezoidal, portions tightly abutting the two side walls, of which they optionally form an extension, and a large central portion comprising two trapezoidal rigid portions connected through a folding line and which at closing are folded in a roof-like manner so as to abut all the side walls in their entire width, and which form an inner obtuse angle with the side walls at a distance from the upper rim of the side walls, as well as optionally two additional triangular side flaps, which in the closed position like the two first-mentioned triangular side flaps closely abut the adjacent side walls and whereby—in case of a bottom cover—said bottom cover comprises only one panel comprising two larger trapezoidal portions and four smaller triangular (in fact trapezoidal) side flaps, which in the unfolded position is shaped like a rectangle, as well as rectangular side flaps, and whereby the triangular side flaps are connected preferably through folding lines to the four adjacent side walls, while the two rectangular side flaps are secured to the adjacent side walls, e.g. by means of an adhesive. In this manner a closing is obtained which is particularly rigid in the direction indicated by the folding rim between the two hinged trapezoidal portions. The tightness in the box is good, the content being kept away from the end rims of the side surfaces by the oblique, top-forming portions, especially away from the end rims not comprising hinged extensions to form panels.

Furthermore according to the invention, the panel finally folded inwards may be provided with flaps on at least two of the free rims, whereby these flaps are bent upwards at the folding inwards of the panel in such a manner that the inner sides of the flaps oppose the inner side of their respective side walls. If desired, the flaps turning upwards may be rugged on the inner side or comprise an adhesive coating. As a result a friction of such a size between the flaps and the side walls may be provided that the cover is locked in the closed position.

The main flap on the cover panel of the box may be extended by a tear-off strip, which along a folding line is bent downwards and secured to the adjacent side wall, e.g. by means of an adhesive.

In this manner a safe securing of the cover panel in the closed position is obtained, until a user opens the box by tearing off the strip.

In the outer triangular side flaps of the cover and in the adjacent side walls, the box may in both sides comprise cut hinged locking flaps to secure the cover upon an opening of the box.

BRIEF DESCRIPTION OF DRAWINGS

The invention will be described below with reference to the accompanying drawing, in which FIG. 5 is an oblique top view of the box of FIG. 2, FIG. 6 is an oblique top view of the box of FIG. 2, but whereby the cover is open, FIG. 7 is an oblique front top view of another embodiment of a box according to the invention and comprising two panels, whereby only the first panel is folded downwards, FIG. 8 corresponds to FIG. 7, but whereby the final panel is almost folded downwards.

FIG. 9 is an oblique top view of the embodiment of FIG. 7, whereby the box is closed.

BEST MODE FOR CARRYING OUT THE INVENTION

Figure 1:
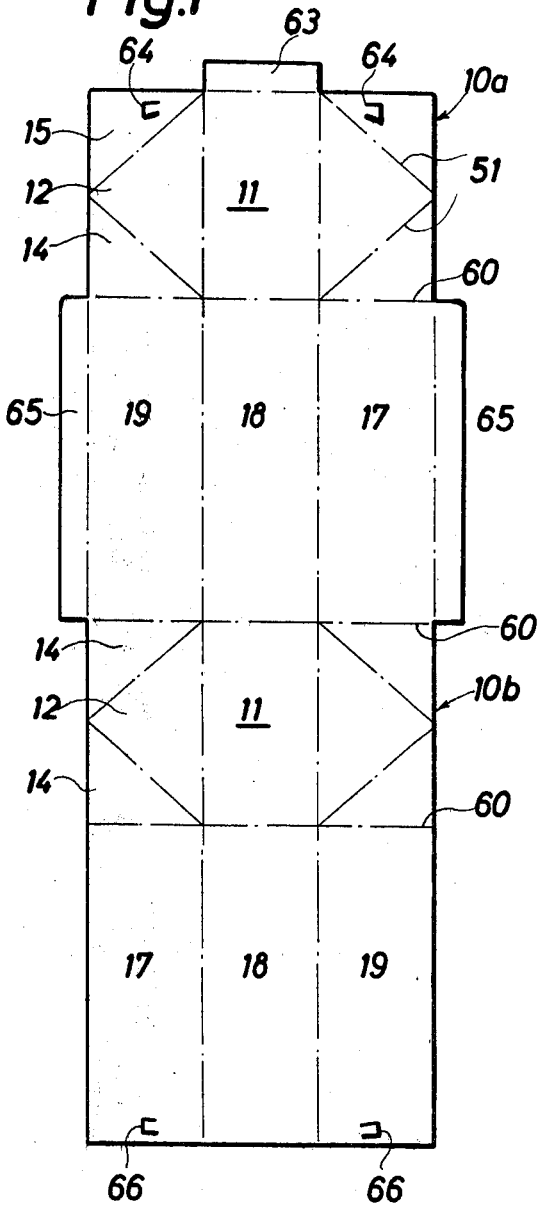
FIG. 1 illustrates a cut blank for a box according to the invention.
Figure 2:
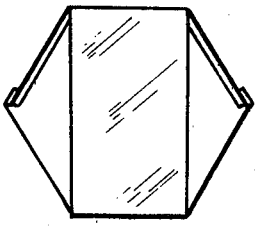
FIG. 2 is a top view of the box in the closed position.

FIGS. 1 to 6 illustrate a particularly advantageous embodiment. The cut blank of FIG. 1 is shaped as an oblong rectangle apart from some narrow assembling flaps 63, 65 projecting a short distance beyond the rectangle. The blank scored as shown is divided into a top cover 10*a*, three side walls 17, 18, 19, a bottom cover 10*b*, and three additional side walls 17, 18, 19. These additional side walls may be assembled in a very simple manner by bending said side walls upwards so as to be perpendicular to the bottom portion 10*b*. The triangle flaps 12, 14, 14 on each side of the bottom cover 10*b* are then bent inwards and upwards into the box in such a manner that the four smallest triangle flaps 14, 14 abut their respective adjacent side wall 17, 19, whereby the side walls are assembled to form a hexagonal cylinder, and are secured by means of the assembling flaps 65. Subsequently, the top cover 10*a* may be bent downwards into the hexagonal cylinder in such a manner that the main flap 11 connects two opposing side walls 18 and furthermore in such a manner that the two isosceles triangle flaps 12 incline to their respective side from the main flap 11 and obliquely downwards towards the side walls 17, 19. The smallest triangle flaps 14, 15 thereby abut these side walls, cf. FIG. 2 being a top view of the box. The free rims of the triangle flaps 15, the side walls 17, 19, and the assembling flaps 65 are in FIG. 2 indicated by double lines, whereas the folded rims (the bends) are indicated by a single line.

Figure 3:
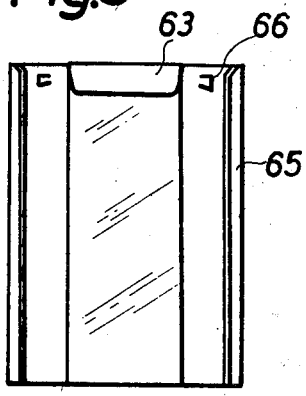
FIG. 3 is a front view of the box of FIG. 2.

FIG. 3 is a front view of the box comprising a tear-off strip 63. This tear-off strip 63 is along a scored line 60 connected to the main flap 10 and bent downwards over and secured to the adjacent side wall, e.g. by means of an adhesive. FIG. 3 furthermore illustrates the assembling of the side walls by means of the assembling flaps 65, e.g. by means of an adhesive. The box comprises locking flaps 64, 66 applicable for securing the cover panel 10 in the closed position after the box has been opened and the tear-off strip 63 removed. The locking flaps 64, 66 are cut both in the triangle flaps 15 of the top cover and in the side walls 17, 19. These locking flaps oppose each other when the box is closed and may be pressed inwards in such a manner that the locking flap 66 is pressed through the aperture appearing in the triangle flap 15 at pressing inwards of the locking flap 64 (by means of the flap 66).

Figure 4:
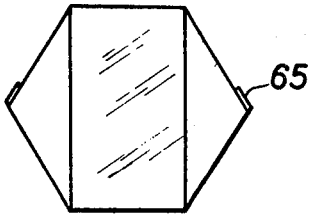
FIG. 4 is a bottom view of the box of FIG. 2.

FIG. 4 is a bottom view of the box, whereby all the rims illustrated are folded rims apart from the lower rims of the assembling flaps, said assembling flaps therefore being indicated by double lines. As it appears from this FIG. 4 all the side walls are connected through folding rims 60 to the bottom cover, thereby ensuring a great tightness.

FIG. 5 is an oblique top view of the box showing the oblique, isosceles triangular flap 12 projecting into the hexagonal cylinder and furthermore tightening and stiffening the box.

FIG. 6 is an oblique top view of an opened box.

The box illustrated in FIGS. 7 to 9 and 16 comprises three pairs of opposing uniform side walls 17*a*, 17*b*, 18*a*, 18*b*, and 19*a*, 19*b* with extensions for forming a cover. These extensions are formed into two panels. The panel 10 to be initially folded inwards comprises a main flap 11 being an extension of the side wall 18*a*, and triangular side flaps 12, 13, 14, and 15 being extensions of the side walls 17*a* and 19*a*. The scored lines 52 and 53, cf. FIG. 16, connect the main flap 11 to the side flaps 12, 13, and the scored lines 51 and 54 connect the side flaps to two additional side flaps 14, 15 connected to the side walls 17*a* and 19*a*.

When the panel 10 is folded downwards, the entire panel is bent inwards along the folding line 60. The triangle flaps 12 and 13 are pressed slightly inwards towards each other, and the scored lines 51 and 54 are bent downwards into the box together with the associated triangles 12, 13, 14, and 15. When the panel is correctly situated, the main flap 11 forms a horizontal, plane connection between the side walls 18*a* and 18*b*. The side flap triangles 14 and 15 tightly abut the associated side walls 17*a* and 19*a*. The side flap triangles 12 and 13 form oblique surfaces for tightening and stiffening the box, just like the first embodiment.

FIG. 7 also illustrates the panel to be folded inwards finally. This panel is shaped in the same manner as the panel initially folded inwards, but the side flaps are cut free of the side walls 17*b* and 19*b*. The final panel is folded inwards by pressing the triangle flaps 22 and 23 a short distance towards each other in such a manner that they may slide downwards over the triangle flaps 12 and 13. When the panel is completely folded, the side flaps 24 and 25 tightly abut the side walls 19*b* and 17*b* in such a manner that friction arises between the side walls and the side flaps if it is tried to open the panel. These surfaces may be rugged or be particularly treated with adhesive or a friction-increasing material to ensure the cover. The oblique surfaces 12, 13 imply in the closed box that the content is kept away from the end rims of the side walls 17*b*, 19*b* cut along the line 60.

FIG. 9 illustrates the closed box. The side walls 17*a*, 17*b*, 19*a*, 19*b* have in this embodiment been reinforced by the side flap triangles 14, 25, 15, 24, and the cover or the end surface is double and comprises the flaps 22, 21, 23 and 12, 11, 13, of which the last three do not appear from FIG. 9.

Figure 12:
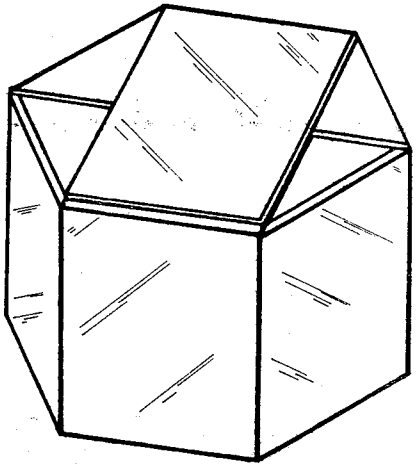
FIG. 12 is an oblique top view of the embodiment of FIG. 10, but in a closed position.
Figure 11:
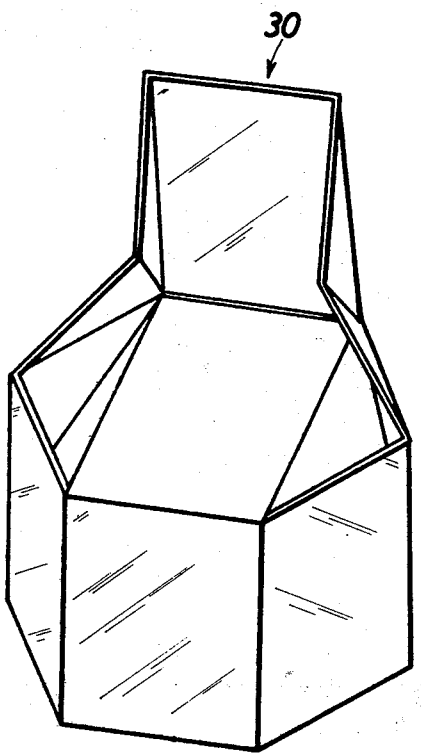
FIG. 11 is an oblique front top view of the embodiment of FIG. 10, whereby the first panel is folded downwards.
Figure 10:
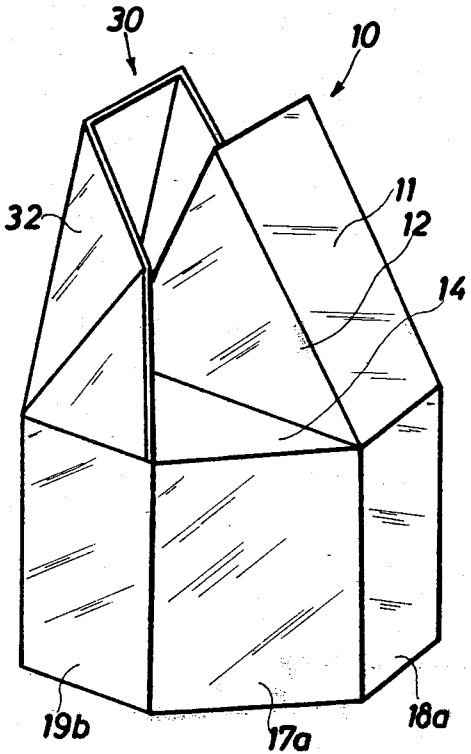
FIG. 10 is an oblique top view of a third embodiment of the box, whereby both panels are partly unfolded.
Figures 13, 14, 15:
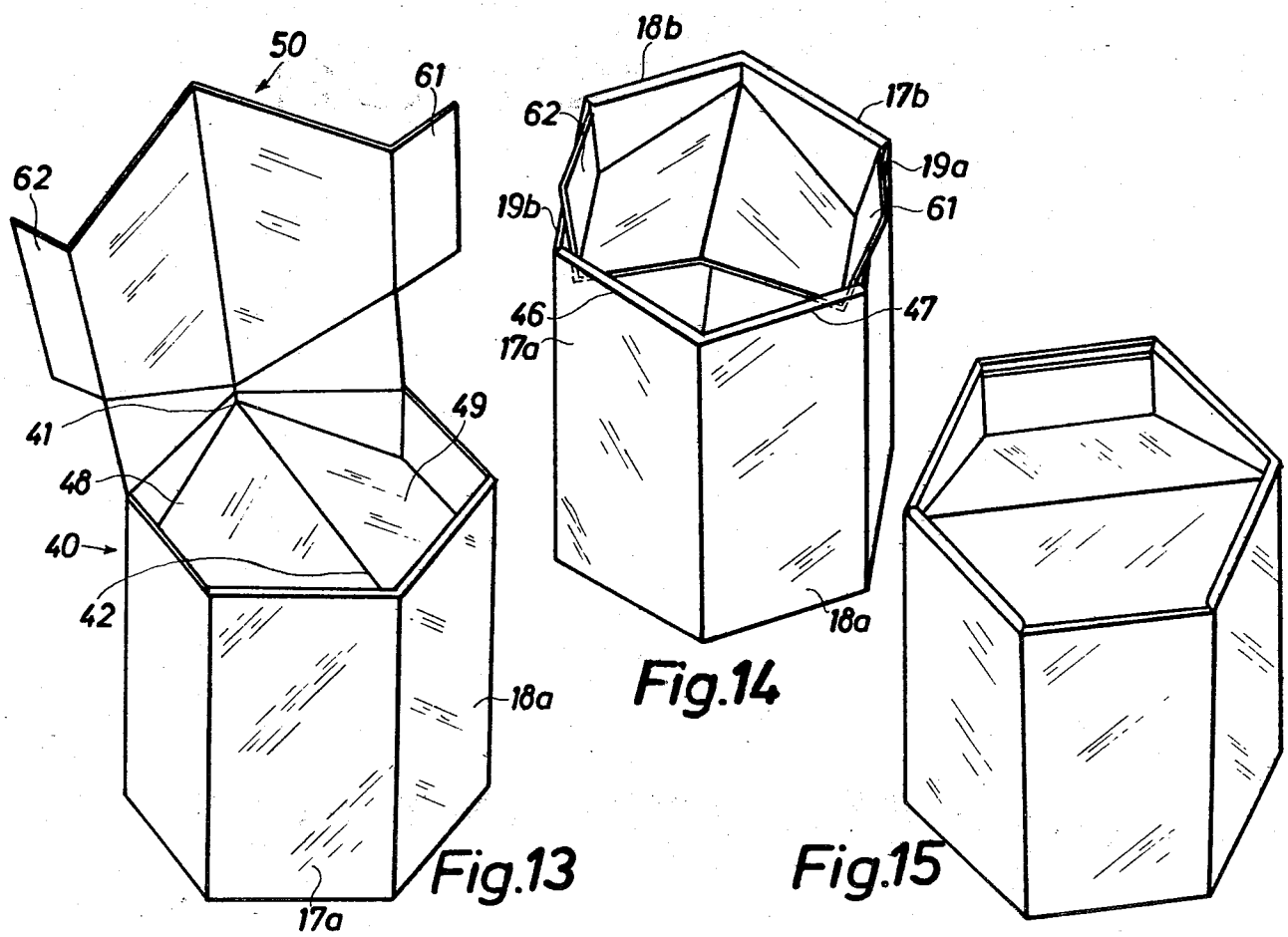
FIG. 13 is an oblique top view of a fourth embodiment of the box, whereby the first panel is folded inwards.
FIG. 14 is an oblique top view of the embodiment of FIG. 13, whereby the second panel is almost folded downwards.
FIG. 15 is an oblique top view of the embodiment of FIG. 13, whereby the closed position appears.
Figure 16:
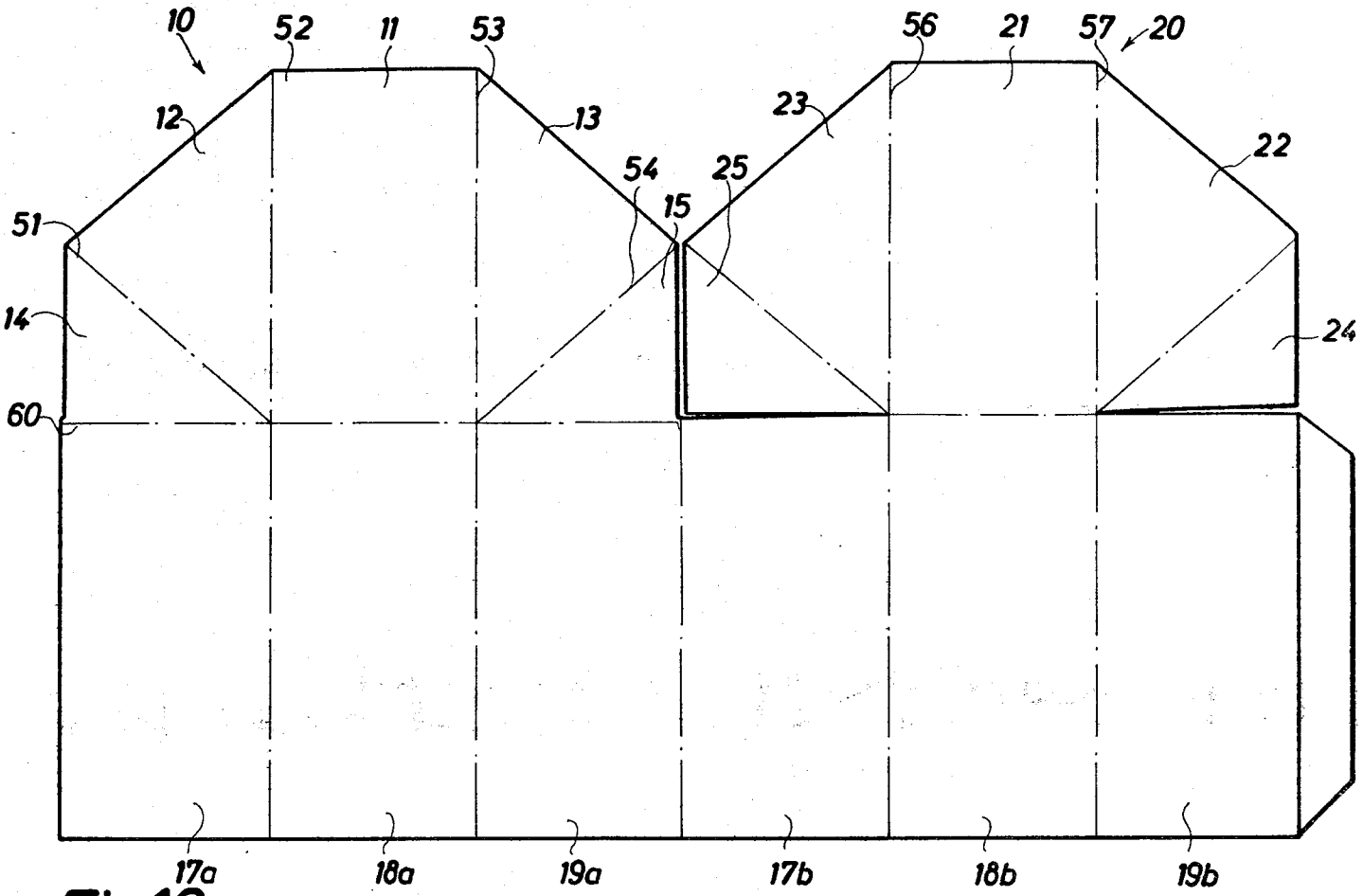
FIG. 16 illustrates a cut and scored blank according to the second embodiment of the invention.
Figure 17:
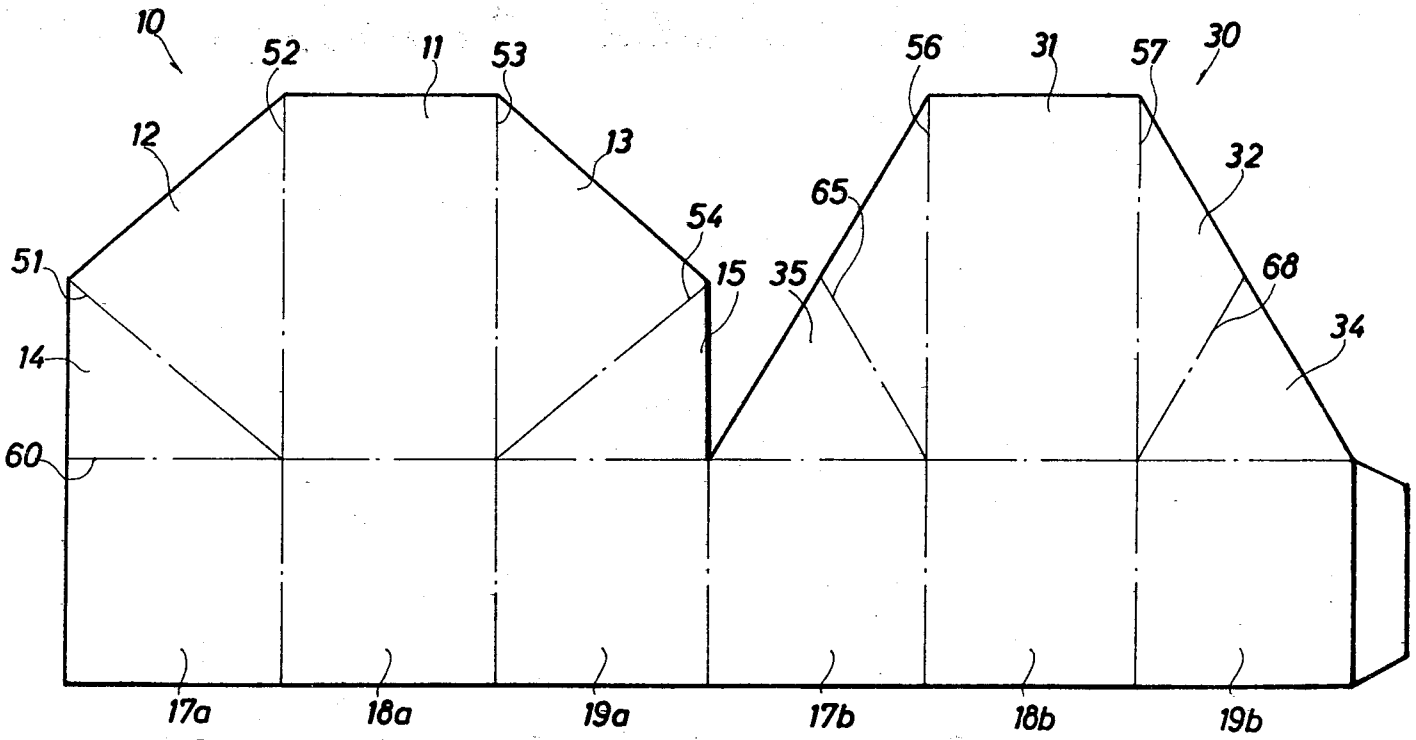
FIG. 17 illustrates a cut and scored blank according to the third embodiment of the invention.
Figure 18:
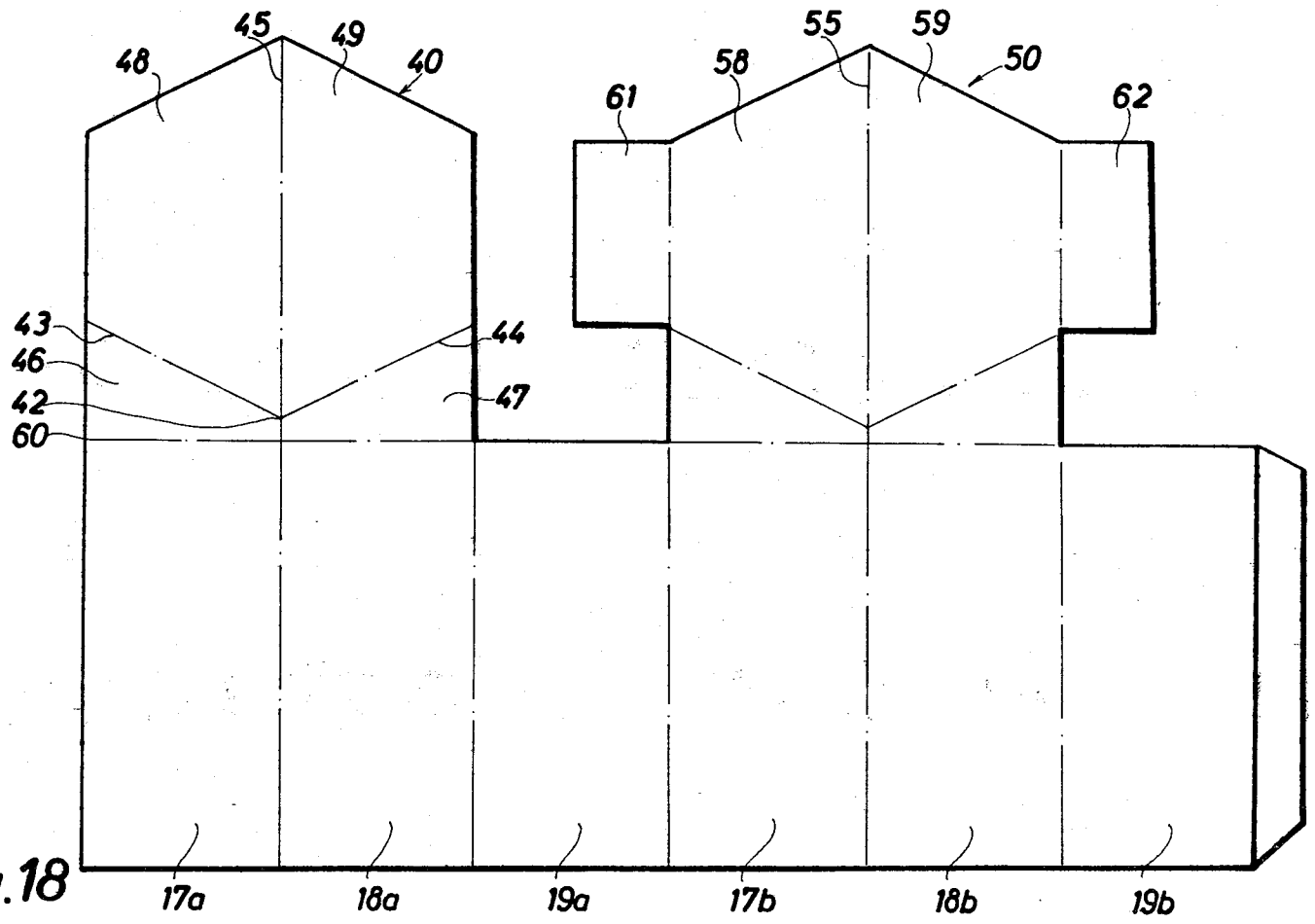
FIG. 18 illustrates a cut and scored blank according to the fourth embodiment of the invention.

FIGS. 10 to 12 illustrate a third embodiment according to the invention. The shape of the cut and scored blank appears from FIG. 17. When comparing FIG. 16 and FIG. 17, it appears that the panel 10 initially folded inwards is identical in these two embodiments. The panel 30 finally folded inwards comprises a main flap 31 and four triangular side flaps 32, 33, 34, and 35, the main flap and two of said side flaps being situated in extension of the side walls 17*b*, 18*b*, and 19*b*. At the closing, the panel is folded along the scored line 60 inwards over the panel 10 initially folded inwards by means of the scored lines 65, 68, 56, and 57. Thereby, the side flaps are situated in almost the same plane. Subsequently, the main flap 31 is secured, e.g. by means of adhesive, to the main flap 11 or the side wall 18*a*. The resulting cover is rigid in all directions across the side walls.

FIGS. 13 to 15, and 18 illustrate a fourth embodiment according to the invention. By this embodiment, the first panel 40 extends from two side walls 17*a* and 18*a* and comprises folding lines 43, 44, and 45 dividing the panel into two smaller triangle-like, in fact trapezoidal side flaps 46, 47, and a large central portion comprising two trapezoidal rigid portions 48, 49 connected through a folding line 45 and which at closing are folded in a roof-like manner so as to abut all the side walls in their entire width, and which form an inner obtuse angle with the side walls 19 at a distance from the upper rim of the side walls while the smaller side flaps 46, 47 after the closing tightly abut the side walls 17*a* and 18*a*. When the panel is completely folded downwards, the folding line 45 extends from the corner 41 to the corner 42 a short distance below the rim of the box.

The final panel 50 is folded downwards by folding about the folding line 60 in a similar manner as the first panel 40. The panel 50, is, however, also provided with side flaps 61 and 62, which at the folding inwards of the panel are bent upwards and tightly abut the side walls 19*a* and 19*b*. The inner sides of these flaps oppose the inner sides of the side walls. These inner sides may be rugged or treated with an adhesive in such a manner that friction arises between the side flaps and the side walls, whereby the panel finally folded inwards is fixed in its closed position folded inwards.

The box according to the invention may also comprise a carrying strap.

What is claimed is:

1. A cut and scored blank suitable for producing a hexagonal box comprising a first side wall section having three rectangular panels articulated in succession by parallel fold lines, a second side wall section having three rectangular panels articulated in succession by parallel fold lines, a top cover section having a central rectangular flap and two rectangular side flaps articulated in extension from said first side wall section on the first parallel fold lines over a fold line perpendicular to the first parallel fold lines, the rectangular side flaps being scored to enable folding each of the side flaps to form one larger triangular area and two smaller triangular areas, such that, upon folding of the blank to form a hexagonal box, the distal end of the central rectangular flap is in abutment with the free end of the center rectangular panel of the second side wall section.

2. The blank as claimed in claim 1 wherein the first side wall section is articulated to the second side wall section by a fold line which is parallel to the first parallel fold lines and to the second parallel fold lines.

3. The blank of claim 1 wherein a bottom section, having a central rectangular panel and two rectangular side panels which are scored to enable folding each of the side panels to form one larger triangular area and two smaller triangular areas is provided in extension of the first side wall section and in extension of the second side wall section over parallel fold lines which are each perpendicular to the first parallel fold lines and to the second parallel fold lines.

4. A hexagonal box made using the cut and scored blank of claim 1.

5. A hexagonal box made using the cut and scored blank of claim 2.

6. A hexagonal box made using the cut and scored blank of claim 3.

* * * * *